US006379542B1

(12) United States Patent
Campbell

(10) Patent No.: US 6,379,542 B1
(45) Date of Patent: Apr. 30, 2002

(54) POOL CLEANER WITH RIGHTING WEIGHT ASSEMBLY

(75) Inventor: Sanford F. Campbell, Redding, CA (US)

(73) Assignee: Letro Products, Inc., Redding, CA (US)

( * ) Notice: Subject to any disclaimer, the term of this patent is extended or adjusted under 35 U.S.C. 154(b) by 0 days.

(21) Appl. No.: 09/662,689

(22) Filed: Sep. 15, 2000

(51) Int. Cl.[7] ..... E04H 4/16

(52) U.S. Cl. ..... 210/169; 210/241; 15/1.7; 4/490; 4/496

(58) Field of Search ..... 210/169, 241; 15/1.7; 4/490, 496

(56) References Cited

U.S. PATENT DOCUMENTS 4,023,227 A * 5/1977 Chauvier ..... 15/1.7
4,642,833 A * 2/1987 Stoltz et al. ..... 15/1.7
5,336,403 A * 8/1994 Marbach ..... 210/169
5,655,246 A * 8/1997 Chang ..... 15/1.7
5,893,188 A * 4/1999 Campbell et al. ..... 15/1.7
6,125,492 A * 10/2000 Prowse ..... 15/1.7

* cited by examiner

*Primary Examiner*—Christopher Upton
(74) *Attorney, Agent, or Firm*—Vierra Magen Marcus Harmon & DeNiro LLP

(57) ABSTRACT

An apparatus for cleaning a surface of a pool submerged in a liquid. The apparatus comprises an elongated cleaning body adapted to migrate across said surface and having a top portion and a bottom portion, a track positioned at the top of the cleaning body, and a ball bearing weight member sealed in the track and having the ability to roll from the first end of the track to the second end of the track.

17 Claims, 10 Drawing Sheets

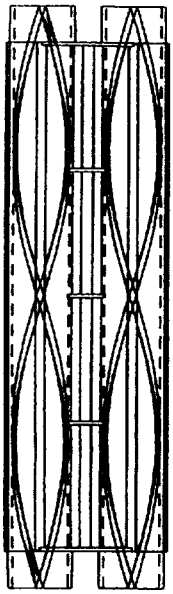
FIG. 7B
FIG. 7A
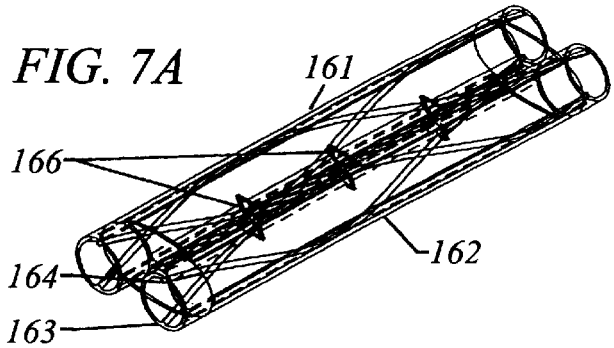
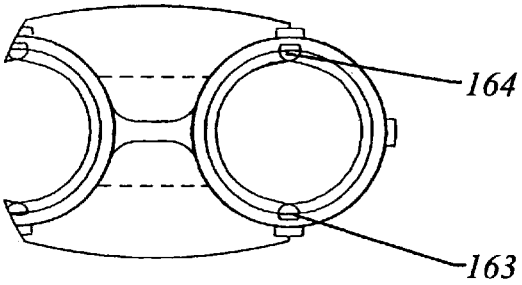
FIG. 7C

POOL CLEANER WITH RIGHTING WEIGHT ASSEMBLY

BACKGROUND OF THE INVENTION

1. Field of the Invention

This invention relates generally to the field of automatic swimming pool cleaners, and more particularly, to submerged suction-type cleaners having generally random travel along the floor and sidewalls of a swimming pool.

2. Description of the Related Art

A swimming pool normally includes a water filtration system for removing dirt and debris from the pool water. Such filtration systems typically include a circulation pump which is installed outside the swimming pool and a piping system for coupling the circulation pump to the swimming pool. The circulation pump draws water from the swimming pool for delivery through the piping system to a filter unit.

One or more baskets are located in the piping system upstream from the filter unit to catch larger debris, such as leaves and the like; the filter unit functions to separate dirt and fine debris from the water. The water is then re-circulated by the pump back to the swimming pool. However, a conventional water filtration system is not designed to remove silt and debris which tends to settle irrespective of size onto the floor and sidewalls of a swimming pool.

To address the foregoing problems, automatic swimming pool cleaners for cleaning the floor and sidewalls of a swimming pool are well known.

There are generally four types of pool cleaners in the pool cleaning market: pressure or return side cleaners; suction cleaners; electric cleaners and in-floor cleaners.

Generally, "pressure" or return-side cleaners use pressurized water from a pump into the cleaner to sweep and collect debris into a bag carried by the cleaner. The cleaner must be able to traverse the entire pool without being toppled. Pressure cleaners both vacuum and sweep, act as a roving return line to circulate pool chemicals and heated water throughout the pool, do not interfere with pool skimmer operation, and have a collection bag to avoid the risk of clogging the pool's skimmer or pump basket and filter with debris.

Pressurized cleaners can be characterized into at least two categories—those requiring a booster pump and those which do not. Booster pumps are used in conjunction with the pools skimmer pump to provide pressurized water to the cleaner at a rate sufficient to operate the cleaner effectively.

However, pressure cleaners can be costly. In addition to the generally higher price of the pressure cleaner itself, many models require a separate pump or "booster pump" to supply water to the cleaner.

Suction side cleaners are generally cheaper in cost, connect to the pool's skimmer and utilize the sucking action of the water being drawn from the pool by the filter pump to vacuum debris. These cleaners do not sweep, nor to they employ a collection bag, as demonstrated by U.S. Pat. No. 5,001,600 (Parenti, et al.). Instead, large debris vacuumed by the suction side cleaners is deposited in the skimmer or pump basket, while sand and silt that is small enough to pass through the skimmer is captured in the pool's filter.

However, because suction cleaners have not been as efficient as pressure cleaners in coverage or cleaning effectiveness, such cleaners are a compromise between effectiveness and cost.

SUMMARY OF THE INVENTION

The invention comprises a unique suction cleaner which includes a number of features which improve the performance of the cleaner over cleaners known in the prior art.

In one aspect, the cleaner comprises an elongated suction tube coupled to a suction source of a pool filtration system. The pool cleaner includes a novel foot pad coupled to the tube, the foot pad having a bottom surface and having provided therein at least two rotatable ball bearing members. The ball bearing members assist the movement of the pool cleaner along the surfaces of a pool being cleaned. In a further aspect, a plurality of, for example, six ball bearings are provided in the foot pad of the pool cleaner of the present invention.

In a further aspect of the present invention, a pool cleaner is provided which includes a suction source connector, a source adaptor coupled to the connector having a first portion of a twist coupling assembly, and a throat assembly adapted to draw debris from the pool into the suction source and having a second portion of the twist coupling assembly. In one aspect, the twist coupling assembly is a bayonet mount assembly, with a first portion of the bayonet assembly comprising a lip, and the second portion comprising a groove, such that when the source adaptor is coupled to the throat assembly, the lip is inserted into the groove, and twisting about an axis secures the source adaptor to the throat assembly. In this unique aspect of the invention, the throat assembly may include a wedge valve which oscillates to seal a first drive tube or a second drive tube, respectively, and the twist coupling assembly may allow easy access to the wedge valve.

In yet another aspect of the invention, a pool cleaner is provided having a unique vortex drive tube assembly. The pool cleaner may comprise a water intake inlet configured to be positioned on an inner surface of a pool, and at least one elongate member coupled to the water intake inlet having a generally cylindrical shape with an interior surface, and at least one corkscrew edge positioned on the interior surface of the elongate member and in communication with the water intake inlet. The corkscrew edge imparts a vortex to the fluid being sucked through the elongate member to increase the suction force provided at the water intake inlet.

Yet another unique embodiment of the present invention comprises a pool cleaner having an adjustable bumper adapter. In this aspect, the pool cleaner comprises a cleaning body adapted to be coupled to a suction source and a foot pad assembly coupled to the elongate member, and at least one deflection member wherein the foot pad assembly includes an adjustable coupling such that the deflection member may be coupled to the foot pad assembly and configured both horizontally and vertically relative to the cleaning body. In particular, a plurality of sockets are provided on the foot pad assembly, and a plurality of snap-fit elements provided on the deflection member, such that the snap elements may be selectively coupled to various ones of the sockets to change the position of the deflection members.

In yet a further aspect of the present invention, the invention comprises a pool cleaner having a bearing weight assembly. The apparatus includes a cleaning body adapted to migrate across a surface of a pool or spa, a track positioned at the top of the cleaning body, and a ball bearing weight member sealed in the track and having the ability to roll from the first end of the track to the second end of the track. In one particular embodiment, the track is semi-circular in shape and formed with a notch at the approximate center of the semicircle. Gravity forces the ball to maintain its position in the notch until the displacement of the cleaner along a line parallel to the track is great enough to dislodge the ball bearing element from the notch. The force imparted to the cleaner by the rapid movement of the ball away from the notch and toward the lower end of the cleaner forces the cleaner into an upright position.

BRIEF DESCRIPTION OF THE DRAWINGS

The invention will be described with respect to the particular embodiments thereof. Other objects, features, and advantages of the invention will become apparent with reference to the specification and drawings in which:

FIG. 7A is a perspective view of the drive tube assembly comprising a first and second drive tubes utilized in accordance with the first embodiment of the present invention.

FIG. 7B is a top view of the drive tube assembly shown in FIG. 7A.

FIG. 7C is a partial cut-away view of the drive tube assembly shown in FIG. 7A.

DETAILED DESCRIPTION

A suction cleaner for pools, spas and the like is hereinafter described. The cleaner includes several novel and advantageous features which alone or in combination render the cleaner superior to those found in the prior art.

Figure 1:
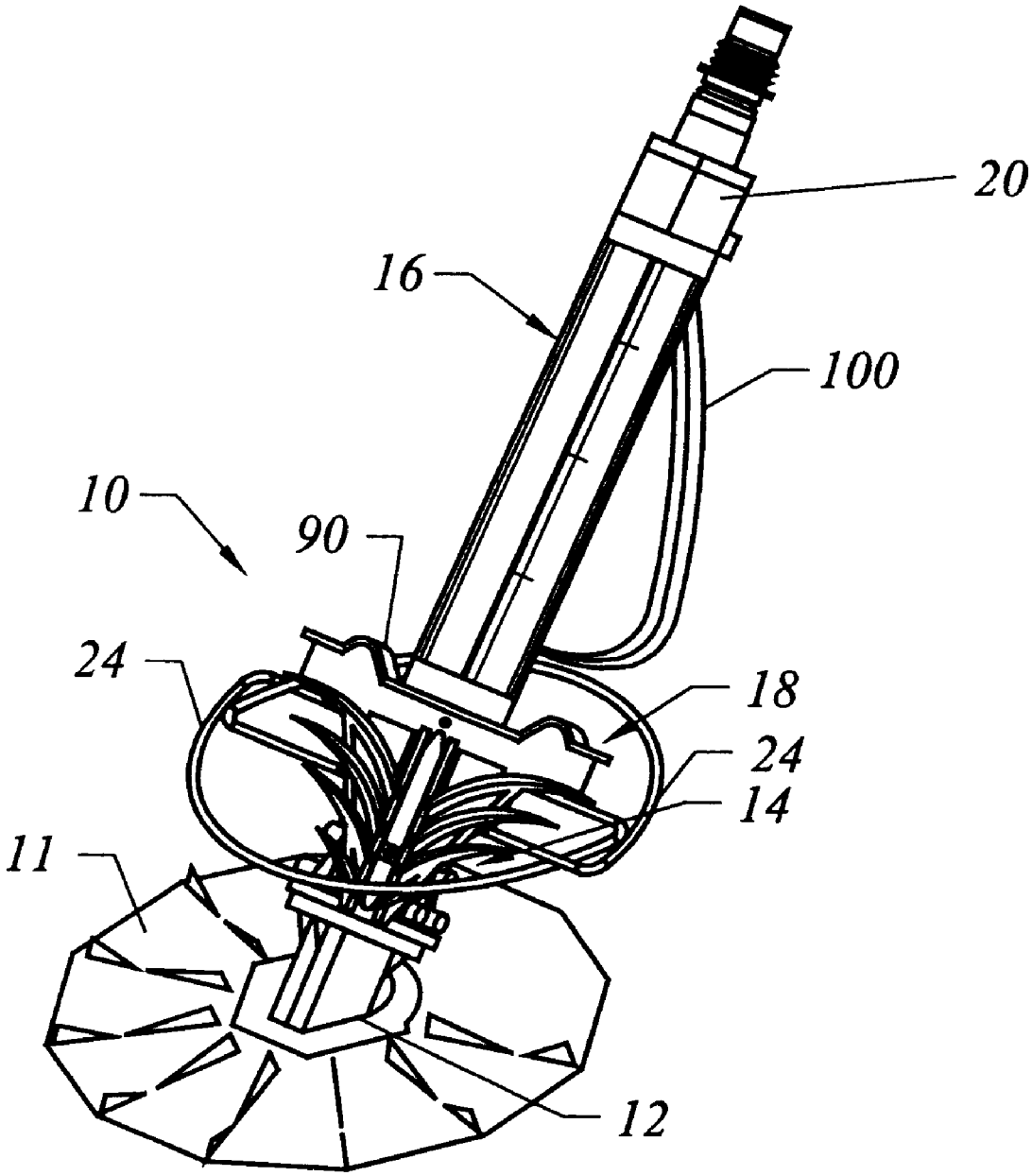
FIG. 1 is a perspective view of the first embodiment of a pool cleaner in accordance with the present invention.

FIG. 1 is a perspective view of a first embodiment of an assembled suction cleaner in accordance with the present invention. The suction cleaner 10 generally includes a pool disk 11, a foot pad assembly 12, a main body 14, a suction tube assembly 16, a weight assembly 18, a swivel head coupling 20, a bumper 100, and adjustable bumper rings 24. In general, a hose (not shown) is coupled to the head coupling 80 and the cleaner thereby connected to a source of suction, such as a skimmer pump or a pump specifically outfitted for use with the cleaner 10, and water is drawn through the cleaner to pull debris from the pool or spa into a filter basket. Unless otherwise indicated, parts of the cleaner 10 described below are constructed of molded plastic. The parts may be fabricated by standard injection molding techniques. Alternative materials and methods of manufacture are contemplated as being within the scope of the present invention as defined herein. Pad 11 is formed of rubber and may have any number of a series of ridges or shapes consistent with its use in encouraging the cleaner 10 into an upright position (illustrated in FIG. 1) so that the mouth of the cleaner (hole 11A in ring 11) engages the bottom of the pool or spa being cleaned, and enhancing the flow of dirt and debris into the mouth 11*a* of the cleaner 10. The ring 11 maintains a fixed engagement with footpad 30 and does not rotate about the foot pad. However, it should be understood that in alternative embodiments of the cleaner the ring may be allowed to rotate freely about the pad or, alternatively, designed to continuously rotate with the movement of the cleaner on the surface of the pool being cleaned. The pliable nature of the ring 11 is such that the cleaner disengages debris on the bottom of the pool and encourages the debris into the cleaner. It should be understood that the ring may have any number of acceptable shapes and forms.

Figure 2:
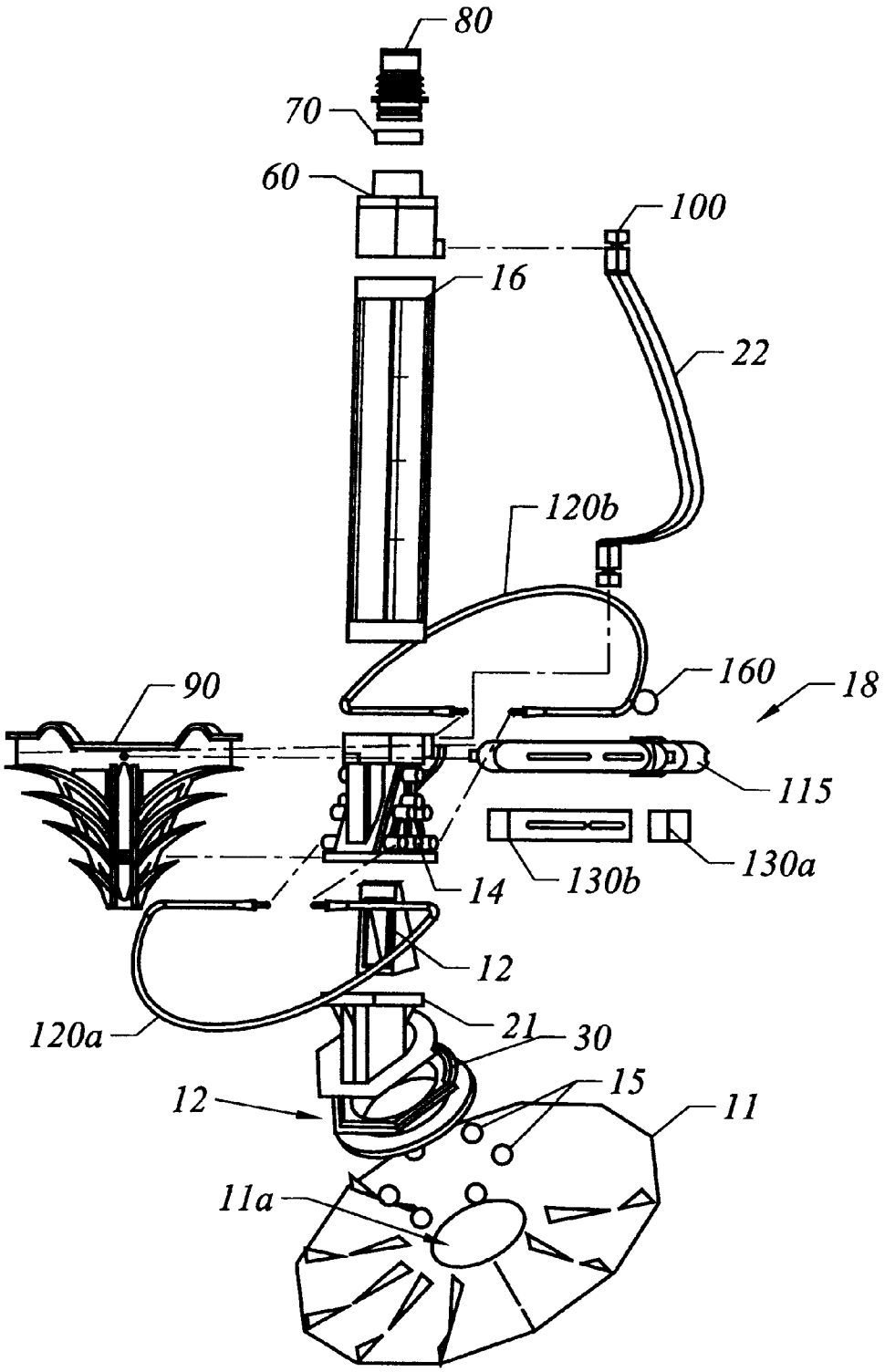
FIG. 2 is an exploded view of a first embodiment of the pool cleaner in accordance with the present invention.
Figure 3A:
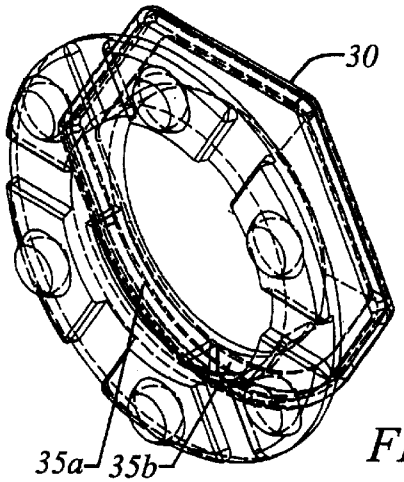
FIG. 3A is a perspective view of a foot pad member utilized in accordance with the first embodiment of the present invention.
Figure 3B:
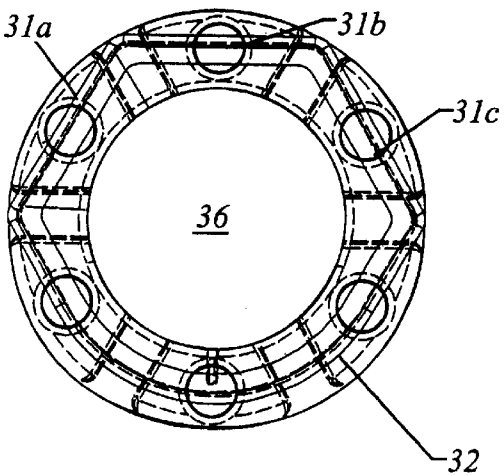
FIG. 3B is a top view of the foot pad shown in FIG. 3A.
Figure 3E:
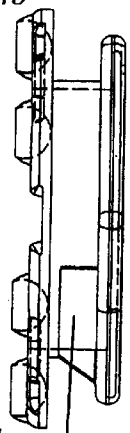
FIG. 3E is a side view of the foot pad shown in FIG. 3A.
Figure 3C:
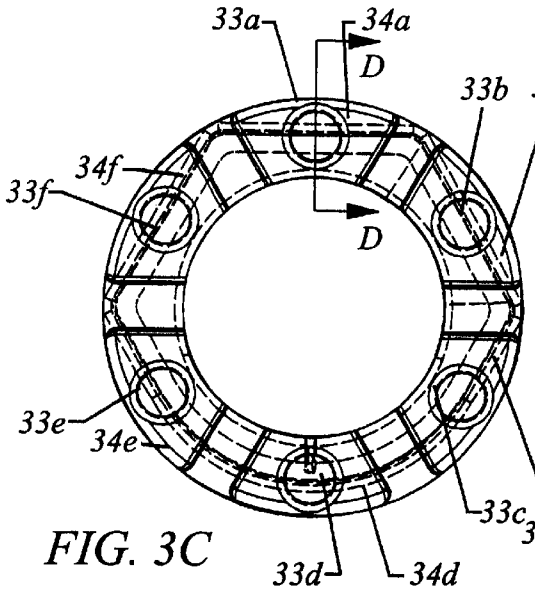
FIG. 3C is a bottom view of the foot pad shown in FIG. 3A.
Figure 3D:
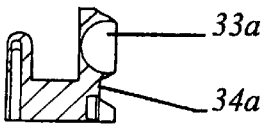
FIG. 3D is a cross section along line D—D in FIG. 3C.
Figure 4A:
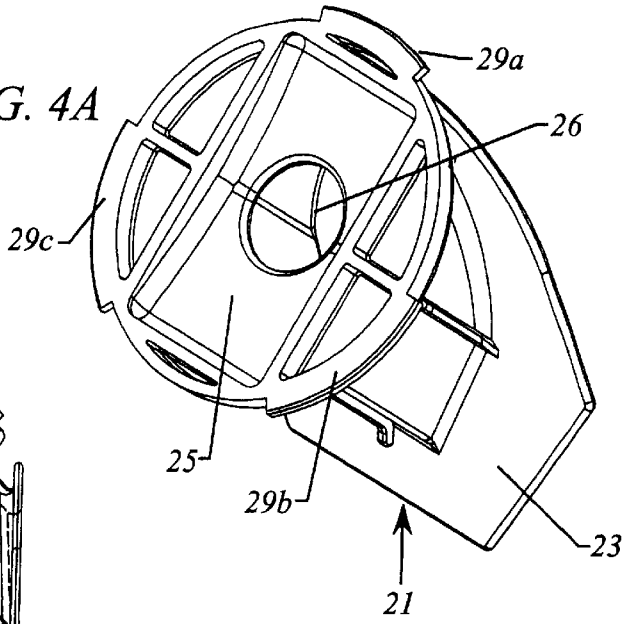
FIG. 4A is a perspective view of the body adapter utilized in the first embodiment of the present invention.
Figure 4B:
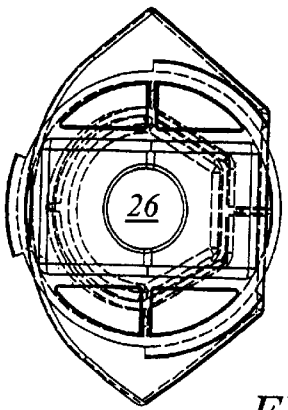
FIG. 4B is a first top view of the body adapter shown in FIG. 4A.
Figure 4C:
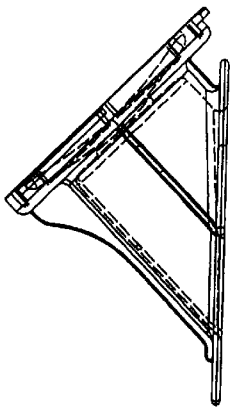
FIG. 4C is a side view of the body adapter shown in FIG. 4A.
Figure 4E:
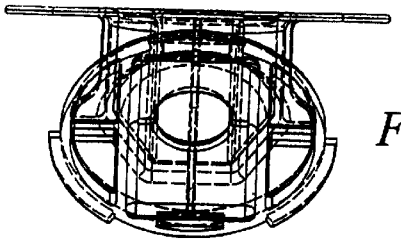
FIG. 4E is a second side view of the body adapter shown in FIG. 4A.
Figure 4D:
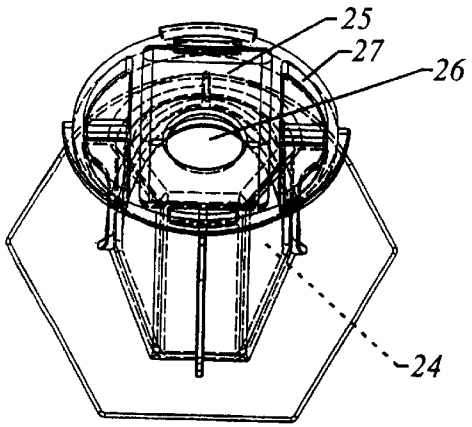
FIG. 4D is a second top view of the body adapter shown in FIG. 4A.

FIG. 2 shows an exploded view of the suction cleaner 10 shown in FIG. 1. Additional elements of the cleaner 10 are shown in greater detail. The foot pad assembly 12 may be comprised of a foot pad 30, and bearings 15, which, as discussed below, are nested in bores in one embodiment of foot pad 30 and enable the foot pad 30 to move efficiently when engaged with a bottom or wall of the pool. A foot pad 30 engages disk 11 and couples disk 11 to the cleaner 10.

The foot pad assembly may further include a body adapter 21 which couples foot pad 30 and main body 14. The foot pad 30 may be adhered to the body adapter 21 through the use of an adhesive, or through formation of a snap fit assembly, such as a tongue and groove assembly wherein a flange portion of adapter 21 engages a groove or lip section of foot pad 30. A wedge 12 is seated in the main body 14 and oscillates therein to direct water flow between each of the two suction tubes which comprise drive tube assembly 16. The drive tube assembly 16 is attached to the main body 14 by engaging formed mounting bores and adhered therein by glue, heat bonding, molding, or other suitable means, and the twister swivel head 60 is likewise attached to the drive tube 16 in a similar fashion. A swivel bearing 70 adjoins the twister swivel head 60 and a hose assembly 80. Assembly 80 engages a flexible hose tube which may be coupled to a skimmer pump, booster pump, or other suitable suction source to draw water through the drive tube assembly. A bumper strap 100 is attached to the device 10 by notches formed at the main body 14 and swivel head 60. Also shown in FIG. 2 are bumper rings 120*a* and 120*b* and a face plate 90. As described below, the bumper rings 120, 120*b* allow the cleaner to more efficiently engage walls, steps and other obstacles in the pool without becoming overturned. A weight assembly 118 includes a weight shell 115, a weight lid 130 and a weight ball 160, and acts to further maintain the upright position of the cleaner 10 in relation to the surfacing being cleaned.

In operation, water is sucked through the pump alternatively between first and second of the drive tubes of assembly 16 to pull debris from mouth 11*a* of the cleaner. The wedge valve 12 oscillates between a first and second positions within the main body 14, alternately sealing one of the two tubes which comprise suction tube assembly 16 to ensure that the flow of suction through the opening at the base of the foot pad is maintained.

FIG. 3 shows a unique feature of the cleaner of the present invention comprising the manner in which the foot pad is allowed to move on the base of the surface of the pool being cleaned. In particular, bearings 150 are provided in the base of the foot pad 30 to allow the foot pad to maintain engagement with the surface being cleaned, while easily moving across the pool surface. Bearings 150 may be comprised of solid form polytetrafluoroethylene (PTFE, commonly known as Teflon®), polyurethane, stainless steel, hard, inert plastic, or any other suitable hard and inert material. FIG. 3A is a perspective view, FIG. 3B a top view, FIG. 3C is a bottom view, FIG. 3D a cutaway view along line D—D in FIG. 3C, and FIG. 3E a side view of the footpad 30. As shown in FIG. 3B, the top of the foot pad is shaped so as to engage a correspondingly-shaped base 22 (FIG. 4) on the twister main body. The top of the foot pad has three straight sides 31A, 31B, 31C and one semicircular side 32. Each side may be formed as a groove or lip such that the body adapter, discussed below, having a mounting plate 23 of corresponding shape and formed as a flange, may be secured therein by a press or snap-fit between the flange and the lip. Alternatively, the footpad 30 may be glued or otherwise bonded to the body adapter 21, by matching the corresponding mounting plate on the main body 14 to the top of the foot pad.

As shown in FIG. 3, approximately six ball bearings 150 are provided in the bottom side of the foot pad assembly, and are mounted in the footpad 30 in bores 33*a*–33*f*. Each bore 33*a*–33*f* is formed in a terrace 34*a*–34*f* and is semispherical in shape to accommodate a ball bearing securely therein. Each bore has a spherical area sufficient to surround more than half of the area of the surface of each ball bearing to secure the bearing in the bore. Each ball bearing may be press fit into the semispherical bore and is retained therein by the sides of the bore. The foot pad assembly shown in FIG. 3 is manufactured by injection molding of a hard, semi-hard rubber material or other suitable inert, moldable material. The circular center 36 of the foot pad serves as the opening 11A through which debris and other materials in the base of the pool will be sucked up into the drive tubes and into the skimmer or other pump/filter assembly. Two vents 35*a*, 35*b* at the rear of the assembly (and directly adjacent the circular edge 32) allow additional suction into the cleaner 10 from the rear of pad 11.

As discussed above, the footpad 30 is attached to the body adapter 21. As shown in FIG. 4, the base 23 of the body adapter 21 has a shape which is identical to the top of the foot pad and includes three straight sides which align with sides 31*a*–31*c* of the footpad 30 and a semicircular side which aligns with side 32 of the foot pad 30. Edges of base 23 may be tapered to facilitate a snap-fit with the lip formed in sides 31*a*–31*c* and side 32. The rubber material used to form foot pad 30 allows the snap-fit of the lip about base 23. This allows the body adapter 21 to be coupled to the foot pad using glue, heat bonding, or other suitable techniques. The body adapter 21 has a central throat 24 which aligns with circular center 36 of the footpad 30 and through which debris is sucked into a central opening 26 in the mounting plate 27.

In a second unique aspect of the cleaner, a bayonet coupling system is utilized to allow access to the cleaner for easy servicing. The mounting plate 27 is generally planer and circular, with three flanges 29*a*, 29*b* and 29*c* which engage main body 14, and a semi-cylindrical recess 25 which provides sufficient clearance for the oscillation of the wedge 12 between a first and second positions defined by the main body about an axis in the main body. Flanges 29*a*–29*c* provide one portion of a bayonet mounting system utilized in accordance with the present invention, and engage corresponding grooves on the main body 14, as discussed further below. While the mounting plate is circular in shape, it should be recognized that the shape of the mounting plate need not be circular and any number of various suitable mounting configurations may be utilized. It should be generally understood that the circular opening 26 of the top of the mounting plate is advantageous to avoiding debris being caught on the edges of the mounting plate. However, the opening may have a number of alternative shapes consistent with allowing debris to pass freely through the throat and into the suction tube assembly 16.

As noted above, wedge 12 is positioned in a triangular cross-sectioned throat 142 of the main body 14. FIGS. 5A–5E show a number of views of the twister main body, and a number of unique features of the present invention. In particular, in FIG. 5A, the bayonet mount grooves which engage the mounting plate on the main body are illustrated. The base 144 of the main body is generally circular and includes a lip 145 with three slots 146*a*, 146*b* and 146*c* which correspond to flanges 29*a*, 29*b* and 29*c*, respectively, thereby allowing the main body to engage the body extension. Once engaged (with the flanges 29*a*, 29*b*, 29*c* wedge inserted in throat 142), the main body is rotated about an axis passing through the center of the throat to secure the main body 14 to the body adapter 21. This further allows easy removal of the main body from the body adapter so that a user of the cleaner to easily and readily access the wedged area in which debris from the pool may become caught for easy cleaning of this area after repeated uses of the cleaner.

Figure 5A:
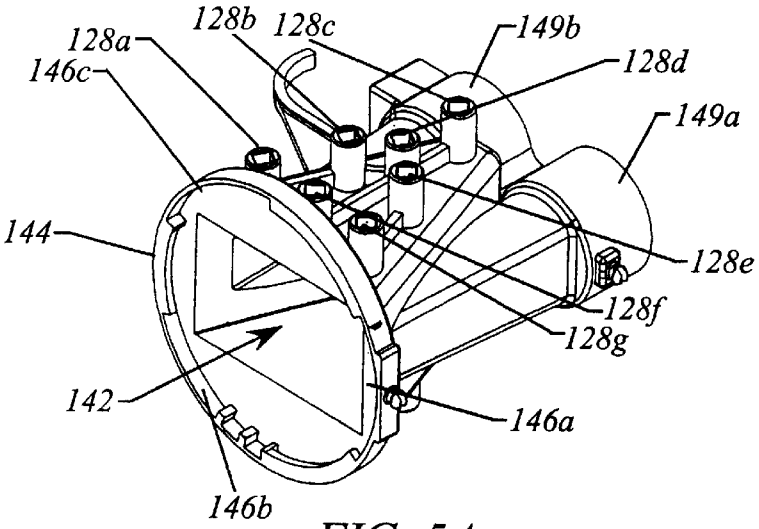
FIG. 5A is a perspective view of the main body element utilized in the pool cleaner of the first embodiment of the present invention.
Figure 5D:
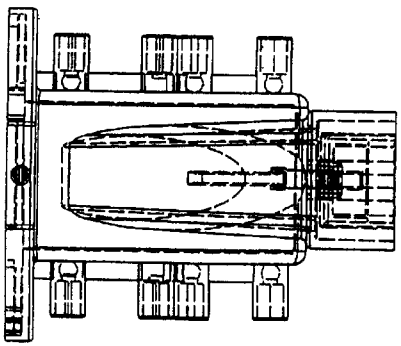
FIG. 5D is a top view of the main body shown in FIG. 5A.
Figure 5C:
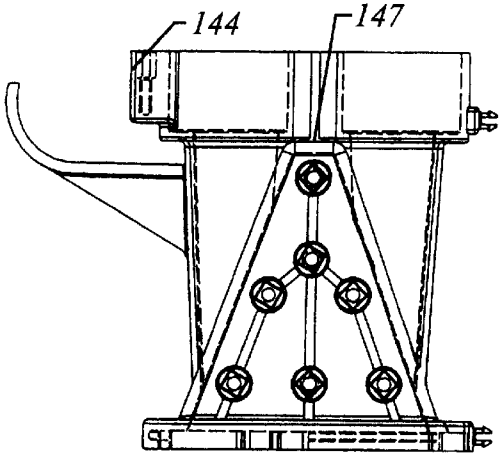
FIG. 5C is a side view of the main body shown in FIG. 5A.
Figure 5B:
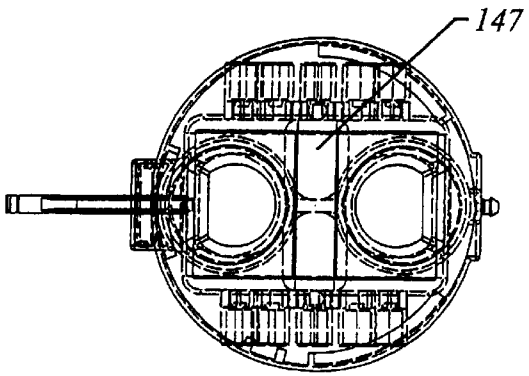
FIG. 5B is a bottom view of the main body shown in FIG. 5A.
Figure 6A:
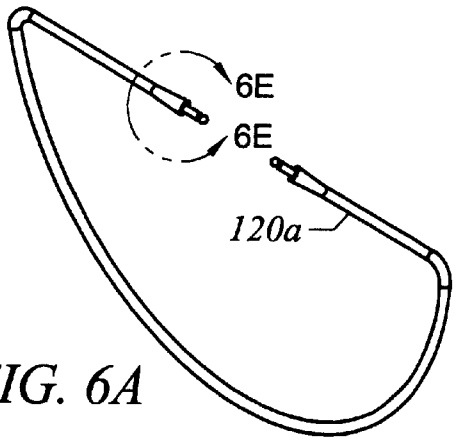
FIG. 6A is a perspective view of a bumper ring utilized in accordance with the first embodiment of the present invention.
Figure 6E:
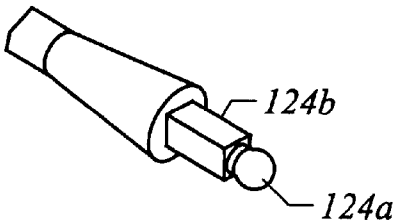
FIG. 6E is a detail view of an end of a first bumper member shown in FIG. 6A.
Figure 6D:
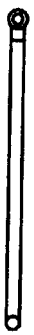
FIG. 6D is a side view of the bumper ring shown in FIG. 6A.
Figure 6B:
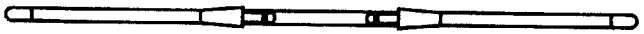
FIG. 6B is an end view of the bumper ring shown in FIG. 6A.
Figure 6C:
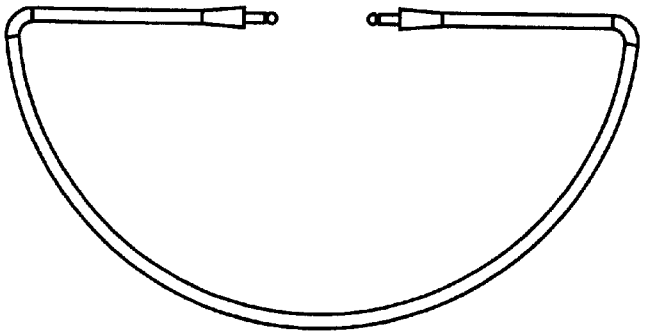
FIG. 6C is a top view of the bumper ring shown in FIG. 6A.

FIGS. 5B–5D are bottom, side, and top views, respectively, of the main body. As shown in FIG. 5B, a notch 147 provided in the throat 142 serves as the base for oscillation of the wedge 12. An edge of wedge 12 rests in notch 147 and wedge 12 is secured in the throat by the coupling between main body 14 and body adapter 21. In operation, the wedge oscillates about this axis and covers one of the two bores 148*a*, 148*b* which are formed in tube mounts 149*a*, 149*b* of the main body 14. The tube mounts and bores engage the drive tube assembly 16 and specifically one of tubes 161, 162. Also included on the main body are a series of sockets 122*a*–*g*, 123*a*–*g* which are utilized, as discussed below, to mount the bumper rings 120 in any number of various configurations. Main body 12 also includes a slide notch mount 144 which allows the bumper strap 100 to be secured to the base of the cleaner.

In a further unique feature of the present invention, adjustable bumpers are provided to allow users to tailor the cleaner to the cleaning application which it serves. FIGS. 6A–6E illustrate one individual bumper 124*a*. As shown in FIG. 1, one or two bumpers may be utilized. As shown in FIGS. 6A–6E, the bumper has a half-circular shape with mounting pins 124, 125 provided on the ends of mounting arms 126, 127. Each pin comprises a ball 124*a*, and rectangular pin 124*b* which engages one of sockets 122, 123. Each rectangular pin 124*b* has a tapered edge to ensure alignment of the pin in the socket. The corresponding socket has a square receptacle. The ball snap fits in a recess (not shown) in one of the sockets and secures the bumper in the socket. In accordance with the invention, the bumper may be placed in any of a combination of the sockets to alter the alignment of the bumper vertically or horizontally.

As noted above, the main body 14 is coupled to the drive tube assembly 16 which are themselves coupled to a hose coupling 20 which secures them to a source of suction, such as a skimmer pump or a booster pump. A second slot mount (not shown) is provided on swivel head 60 to couple the upper portion of rear bumper 100.

FIGS. 7A–7C shows perspective and cross-sectional views of a novel drive tube assembly 16 in accordance with the present invention. As shown in FIG. 7A, the drive tube assembly 16 has two individual tubes 161, 162. Each tube includes two interior ridges 163, 164 which are formed on the interior of each tube in a corkscrew-like fashion along the interior thereof. The ridges generate a vortex in the water flow when suction pulls water through the tubes. The vortex flow of the water increases the suction at the hole 26 and consequently the suction power of the cleaner. This, in combination with the alternating oscillation of the wedge, ensures powerful suction by the cleaner on the pool wall. The wedge oscillation also ensures that the cleaner does not become jammed on any wall by forcing a displacement of the cleaner. Each ridge has a semicircular cross-section and makes at least one revolution down the length of the tube. As the tubes are approximately sixteen inches in length, with an interior radius of 0.75 inch, the interior corkscrew edge thereof has a height of approximately 0.094 inch. It should be recognized that the dimensions are only illustrative. As shown in FIG. 7A, the tubes 161, 162 are joined by molded struts 166 to enhance stability in the cleaner. In an alternative embodiment, each tube may be formed individually and not secured to the other tube.

It should be recognized that various lengths and twists in the corkscrew design of these interior edges may be made without departing from the scope and nature of the present invention (e.g. greater than the single full 360° revolution of one edge, less than the 360° revolution, multiple or partial revolutions, etc.). In operation, the corkscrew edges impart a vortex-like motion to the water, increasing the force with which water is drawn to the suction tube and the suction force at the base of the foot pad. This allows the cleaner to be more efficient using the same pressure as other cleaners.

As noted above, the drive tube assembly is coupled to a swivel head which combines the flow of the two tubes into a single outlet. A swivel bearing is provided between a threaded hose connector 80 so that the hose may freely rotate about the swivel head 60.

Figure 8A:
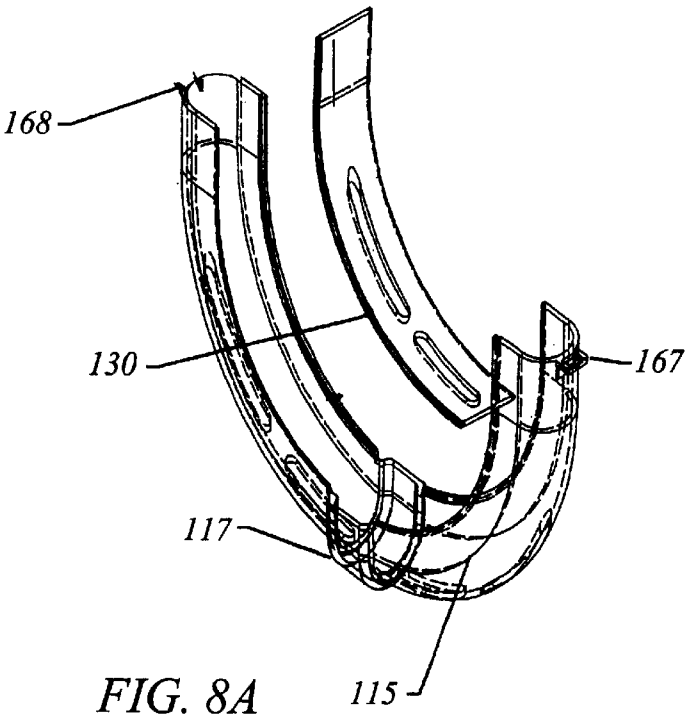
FIG. 8A is a perspective view of the weight track member and cover utilized in accordance with the invention shown in FIG. 1.
Figure 8C:
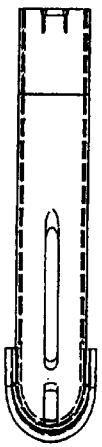
FIG. 8C is an end view of the weight track assembly shown in FIG. 8A.
Figure 8B:
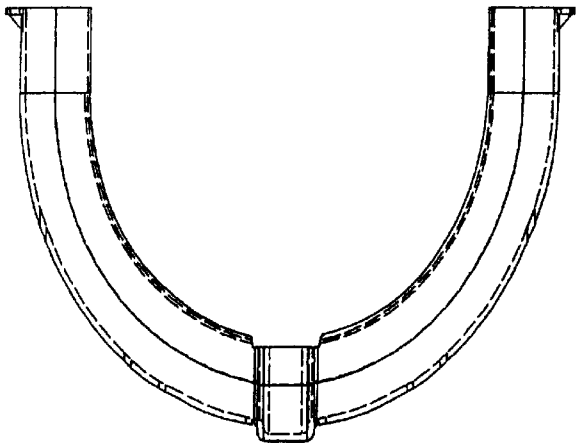
FIG. 8B is a side view of the weight track assembly shown in FIG. 8A.

FIG. 8 is a depiction of the weight assembly track of the present invention. The assembly works to right the cleaner when the cleaner departs from the upright position shown in FIG. 1. FIG. 8A shows weight track 130 and one of two covers 130*a* utilized to secure bearing weight 160 in the track 130. In operation, a ball bearing weight 160 is placed in the weight track 130, allowing the bearing weight 160 to move from the first end to the second end under the force of gravity within the fluid in the pool. The track has a semicircular shape and is secured to face plate 90 by tabs (not shown) on the face plate 90 which engage slot connectors 167, 168 on the track. When mounted to cleaner 10, the center of track 130 (notch 117) lies directly beneath tube assembly 16. The natural tendency of the weight is to remain in the center of the track 130 in notch 117. As the cleaner moves through the pool, it will encounter steps, edged slopes, and other obstacles which will cause the cleaner to turn on its side (rotating parallel to the length of the track 130). In addition, the suction force of the cleaner also pulls the cleaner toward the edge of the pool, causing it to turn on its side. When this happens, the ball weight will naturally find the lowest point of the track as the track is oriented with respect to the cleaner, but will resist movement until the slope of the track exceeds the resting force of the ball in notch 117. Once the weight does move from the notch to the lowest oriented point of the track, the ball will move quickly due to the kinetic energy stored by the slope angle of the track required to dislodge the ball, and the ball's rapid movement toward the end of the track imparts a force to the cleaner to return to the upright position. Consequently, the weight 160 will return to the notch. In an alternative embodiment a second weight, and/or additional weights, may be utilized so long as notch 117 is of sufficient size to retain the weights therein in accordance with the foregoing description.

Figure 9:
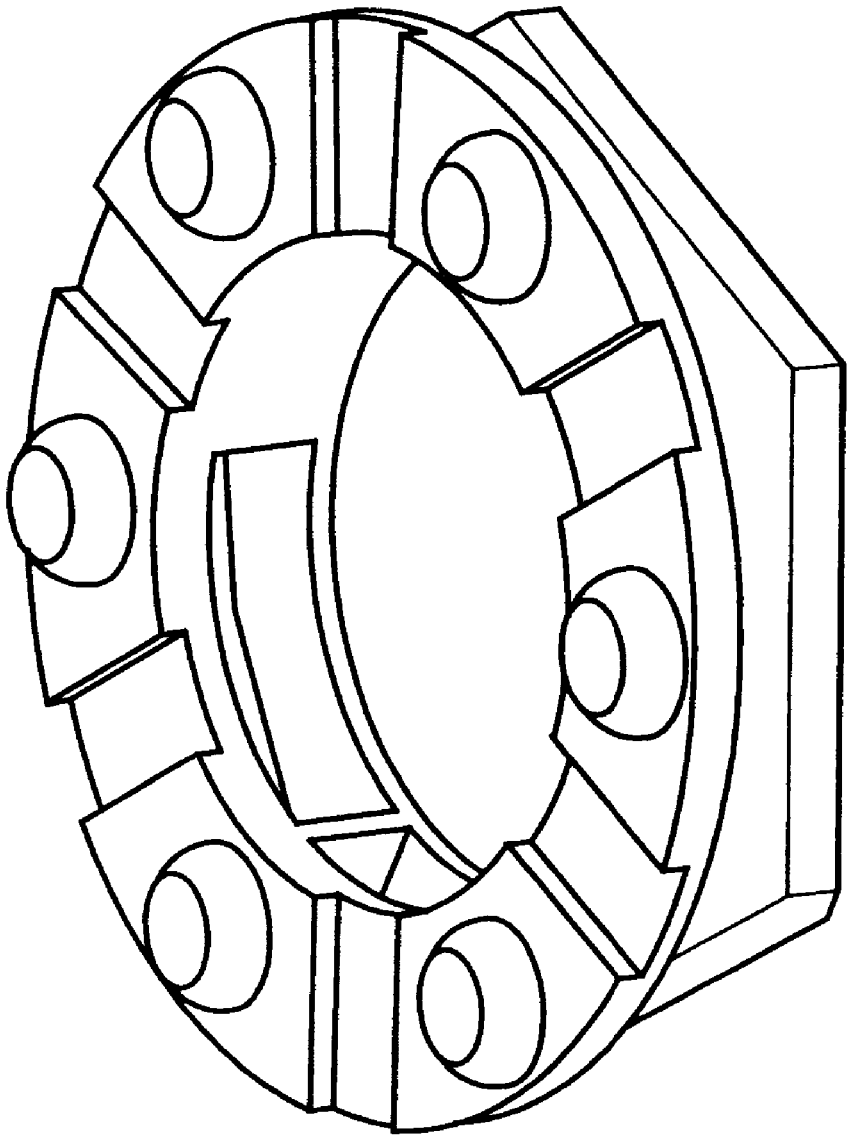
FIG. 9 is a perspective view of an alternative embodiment of the foot pad assembly utilized in accordance with a second embodiment of the present invention.

FIG. 9 shows an alternative embodiment of the foot pad of the present invention. As shown therein, the pad does not utilize ball bearing members on the base of the pad, but instead terraces are formed without the mounting bores and the pad skims along the bottom of the surface without the assistance of the bearings.

Figure 10B:
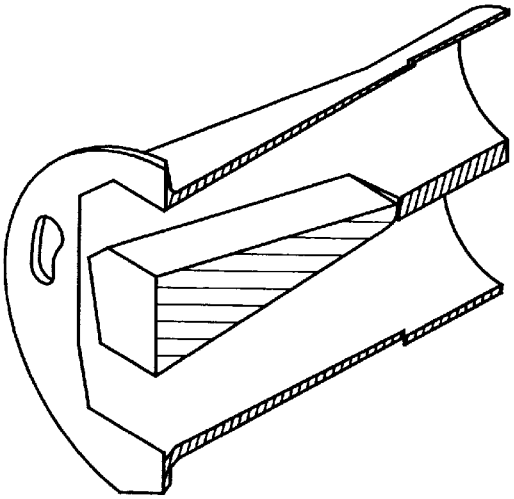
FIG. 10B is a partial cut-away perspective view of the alternative wedge assembly utilized in accordance with the present invention.
Figure 10A:
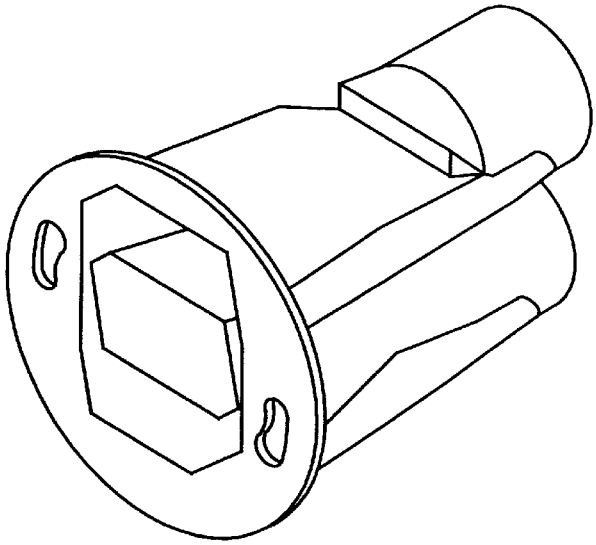
FIG. 10A is a perspective view of a second embodiment of the wedge and main body assembly.
Figure 10C:
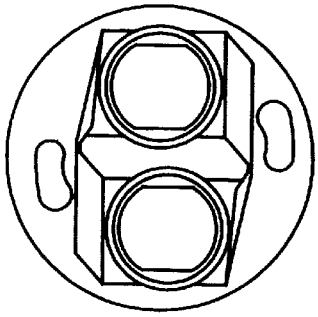
FIG. 10C is an end view of the alternative main body assembly.

FIGS. 10A, 10B, and 10C show an alternative embodiment of the main body. As shown therein, the wedge assembly has a six-sided shape, including a top and bottom edge, two long side edges, and two short side edges. Correspondingly, the throat of the main body has an eight-sided shape to allow the offset wedge assembly to rotate along an axis which is not perpendicular to the drive tubes. In operation, the offset wedge assembly allows the wedge to move more efficiently through the water being sucked through the throat.

The many features and advantages of the present invention will be readily apparent to one of average skill in the art. It should be readily recognized that alternate materials and manufacturing methods may be utilized to form different parts shown herein. In addition, modifications such as change in the shape of the bayonet coupling assembly, the length of the tubes, the number of times the edge within the tube makes a corkscrew within the tube, are all modifications which are contemplated as being within the scope of the present invention. All such features and modifications of the present invention are intended to be within the scope of the application as defined by the following claims.

What is claimed is:

1. An apparatus for cleaning a surface of a pool submerged in a liquid, said apparatus comprising:

an elongated cleaning body adapted to migrate across said surface and having a top portion and a bottom portion;

a track positioned at the top of the cleaning body;

a ball bearing weight member sealed in the track and having the ability to roll from the first end of the track to the second end of the track; and a recessed portion located approximately at a center of said track for retaining the ball in said center of the track during minor movements of said elongated cleaning body.

2. The apparatus of claim 1 wherein the track has a semi-circular shape such that the center of the semicircle is coupled adjacent to the cleaning body, while a first end and a second end are positioned upwards and away from the cleaning body.

3. The apparatus of claim 1 wherein the recess has a size sufficient to return the ball bearing weight.

4. The apparatus of claim 1 wherein said cleaning body comprises a foot pad assembly including a pliable pool pad having a generally planar shape parallel to a bottom surface of said foot pad, a main body coupling the foot pad assembly to a drive tube assembly, the drive tube assembly being coupled to a source of suction wherein the track is positioned on the main body.

5. The apparatus of claim 1 wherein the track includes a cover to seal the ball bearing in the track.

6. The apparatus of claim 1 wherein the track is semi-circular in shape.

7. A pool cleaning apparatus comprising:

a housing including a water intake inlet configured to be positioned on an inner surface of said pool while sucking water from said pool so as to suck debris from said inner surface of said pool;

a track having a first end and a second end positioned over the water take inlet on the cleaning apparatus;

a rolling weight member positioned in the track and being free to roll from a first end of the track to the second end of the track; and a recessed portion formed in said track, approximately midway between said first end and said second end of said track.

8. The pool cleaning apparatus of claim 7 wherein the track has a semi-circular shape such that the center of the semicircle is coupled below and adjacent to the housing, while a first end and a second end are positioned upwards and away from the housing.

9. The pool cleaning apparatus of claim 8 wherein said recessed portion is located at the approximate center of said semi-circular track, said recessed portion being provided adjacent to the housing.

10. The pool cleaning apparatus of claim 9 wherein the recess has a size sufficient to retain the ball bearing weight.

11. The pool cleaning apparatus of claim 7 wherein the track includes a cover to seal the ball bearing in the track.

12. The pool cleaning apparatus of claim 7 wherein the track is semi-circular in shape.

13. An apparatus for cleaning a surface of a pool submerged in a liquid, said apparatus comprising:

an elongated cleaning body having a bottom end adapted to migrate across said surface;

a track affixed to said elongated cleaning body, said track having a first end and a second end; and a rolling weight member positioned in said track, said rolling weight creating potential energy relative to said elongated cleaning body upon said bottom end encountering a first force due to an uneven portion of said surface, said rolling weight member rolling in said track to convert said potential energy to kinetic energy upon said first force exceeding a threshold magnitude, said potential energy generating a second force exerted on said elongated cleaning body to counteract said first force.

14. An apparatus for cleaning a surface of a pool as recited in claim 13, said track having a semicircular shape partially circumjacent about said elongated cleaning shaft.

15. An apparatus for cleaning a surface of a pool as recited in claim 13, said track including a recessed portion for holding said rolling weight member therein, said potential energy being generated by said rolling weight member remaining in said recessed portion upon said bottom end of said elongated cleaning shaft encountering said uneven portion.

16. An apparatus for cleaning a surface of a pool as recited in claim 15, said kinetic energy being generated by said rolling weight member falling out of said recessed portion.

17. An apparatus for cleaning a surface of a pool as recited in claim 15, said recessed portion located approximately halfway between said first and second ends of said track.

* * * * *